US010792826B2

(12) United States Patent
Glaser

(10) Patent No.: US 10,792,826 B2
(45) Date of Patent: Oct. 6, 2020

(54) RAZOR WITH EXTENDABLE TRIMMER

(71) Applicant: Todd M. Glaser, Miami Beach, FL (US)

(72) Inventor: Todd M. Glaser, Miami Beach, FL (US)

( * ) Notice: Subject to any disclaimer, the term of this patent is extended or adjusted under 35 U.S.C. 154(b) by 31 days.

(21) Appl. No.: 16/202,518

(22) Filed: Nov. 28, 2018

(65) Prior Publication Data

US 2019/0176354 A1 Jun. 13, 2019

Related U.S. Application Data

(60) Provisional application No. 62/596,372, filed on Dec. 8, 2017.

(51) Int. Cl.
*B26B 21/40* (2006.01)
*B26B 21/52* (2006.01)
*B26B 21/44* (2006.01)

(52) U.S. Cl.
CPC ..... *B26B 21/4031* (2013.01); *B26B 21/4043* (2013.01); *B26B 21/4062* (2013.01); *B26B 21/521* (2013.01); *B26B 21/443* (2013.01)

(58) Field of Classification Search
CPC ..... B26B 21/4031; B26B 21/4062; B26B 21/521; B26B 21/4043; B26B 19/148
USPC ..... 30/29.5
See application file for complete search history.

(56) References Cited

U.S. PATENT DOCUMENTS 4,285,124 A * 8/1981 Diakonov ..... B26B 21/20 30/32
2008/0016691 A1* 1/2008 Pennella ..... B26B 21/40 30/34.1
2012/0084984 A1* 4/2012 Davis ..... B26B 21/4043 30/50
2014/0052165 A1* 2/2014 Bilenski ..... A61B 17/3211 606/170
2018/0368549 A1* 12/2018 Mehaddene ..... B26B 21/446
2020/0130208 A1* 4/2020 Anjum ..... B26B 21/521

* cited by examiner

*Primary Examiner* — Kenneth E Peterson
*Assistant Examiner* — Sina A. Shayan
(74) *Attorney, Agent, or Firm* — Trueba & Suarez PLLC; William R. Trueba, Jr.; Roberto M. Suarez

(57) ABSTRACT

A razor for shaving hair and trimming nose hair, including a head with a razor blade for shaving hair, the head having a head side and a trimming blade for cutting nose hair, the trimming blade extending from the head side of the head when deployed, and the trimming blade being recessed completely in the head when retracted. A method for deploying a trimming blade on a razor for shaving hair and trimming nose hair, including depressing a plunger on a handle, engaging a linkage system in a handle that connects the plunger to a trimming blade on a head, the head including a razor blade for shaving hair, deploying the trimming blade from said head, depressing the plunger on the handle again, and retracting the trimming blade into a razor side of the head.

6 Claims, 5 Drawing Sheets

RAZOR WITH EXTENDABLE TRIMMER

CROSS-REFERENCE TO RELATED APPLICATIONS

This patent application claims the benefit under 35 U.S.C. § 119(e) of U.S. Provisional Patent Application No. 62/596,372, filed Dec. 8, 2017, which application is incorporated herein by reference.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Handheld razors are designed to shave hair on the human body. The most common uses of handheld razors are for men shaving their facial hair and women shaving their legs. Over the years, electric razors have gained in popularity. Some users prefer the cut of their hair using non-electric straight edge razors, while other users prefer the cut of electric razors.

The trimming of nose hair and ear hair has also developed over the years. Men would trim nose hairs with scissors. Over the past few decades, specific nose and ear hair electric trimmers have come on the market. These devices are independent devices from handheld razors.

Users who use traditional handheld non-electric razors are forced to use a separate device to trim nose and/or ear hair. Their existing non-electric razors do not have the functionality to trim nose and/or ear hair. The razor blades are too wide to navigate the trimming of hair near the openings of the nasal cavity and ear canal. Users attempting trim their nose/ear hair with a conventional razor blade will likely injure themselves trying to use a razor blade designed to trim more open areas, such as a face and legs.

Users need a conventional non-electric razor that has the added functionality to trim nose and ear hairs, in conjunction with shaving facial or leg hair.

As can be derived from the variety of devices and methods directed at trimming nose/ear hair, many means have been contemplated to accomplish the desired end, i.e., trimming nose/ear hair. Heretofore, tradeoffs between the number of shaving accessories and accuracy were required. Thus, there is a long-felt need for a conventional non-electric razor that can trim nose/ear hair. There is a further long-felt need for a retractable trimming blade on a conventional non-electric razor that can trim nose/ear hair as desired by the user.

FIELD OF THE INVENTION

The invention relates to razors, particularly to facial hair razors, and even more particularly to nose-hair trimmers.

BRIEF SUMMARY OF THE INVENTION

An object of the invention is to provide a razor that can shave hair in spaces, such as the nose and ear, where the head of a razor is too wide to fit.

Another object of the invention is to provide a razor for shaving hair and trimming nose hair, including a head with a razor blade for shaving hair, the head having a head side and a trimming blade for cutting nose hair, the trimming blade extending from the head side of the head when deployed, and the trimming blade being recessed completely in the head when retracted.

Yet another object of the invention is to provide a method for deploying a trimming blade on a razor for shaving hair and trimming nose hair, including depressing a plunger on a handle, engaging a linkage system in a handle that connects the plunger to a trimming blade on a head, the head including a razor blade for shaving hair, deploying the trimming blade from said head, depressing the plunger on the handle again, and retracting the trimming blade into a razor side of the head

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "trimming blade" is synonymous with terms such as "razor", "cutting blade", "straight edge", "knife", and such terms may be used interchangeably as appearing in the specification and claims. Although any methods, devices or materials similar or equivalent to those described herein can be used in the practice or testing of the invention, the preferred methods, devices, and materials are now described.

FIGS. 1-9 show a preferred embodiment of a razor for shaving and trimming nose hair with an extendable trimming blade.

Figure 2:
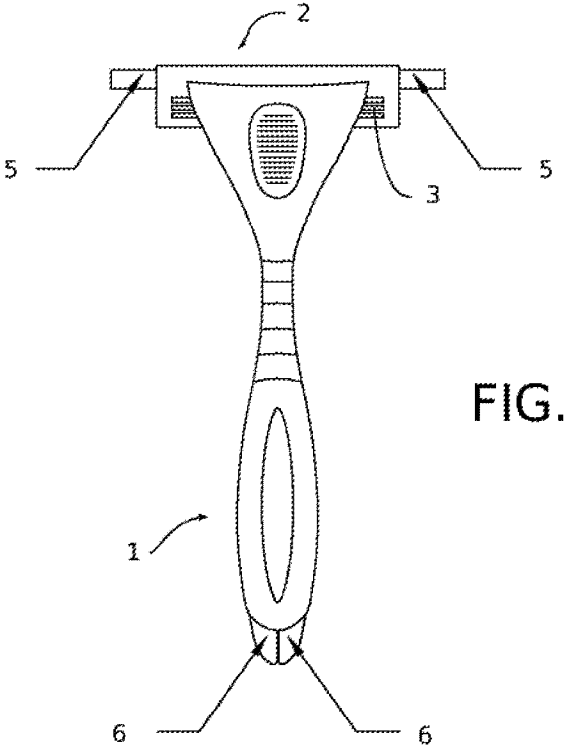
FIG. 2 is a rear elevational view of the razor shown in FIG. 1.
Figure 1:
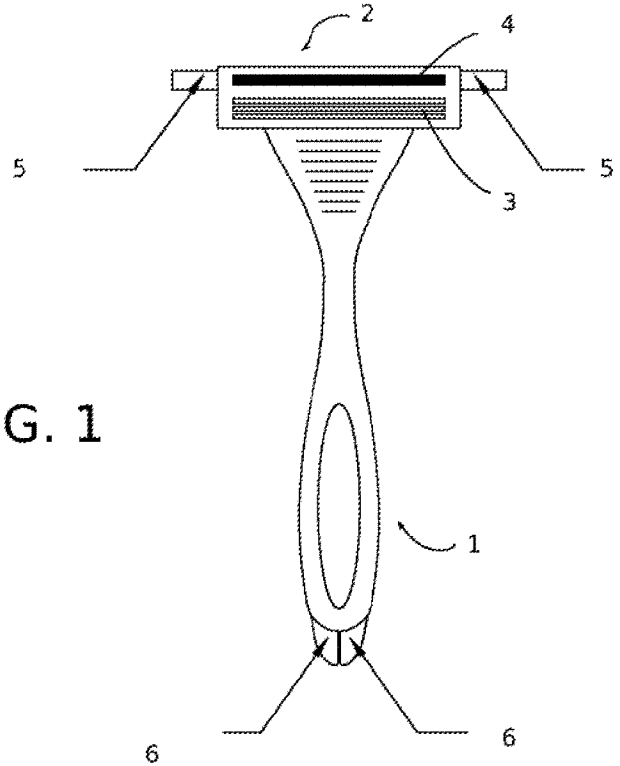
FIG. 1 is a front elevational view of a razor according to the invention, showing the trimming blades extended.
Figure 3:
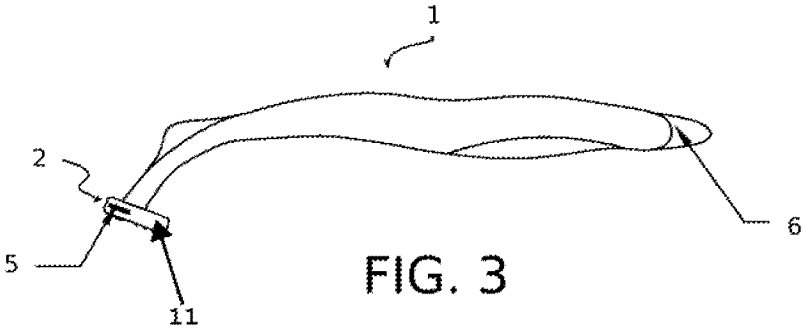
FIG. 3 is a left elevational view of the razor shown in FIG. 1.
Figure 5:
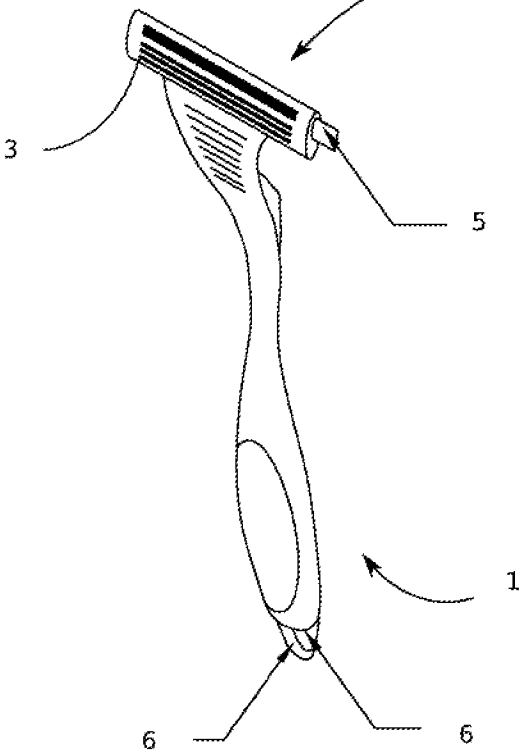
FIG. 5 is a top, front, left perspective view of the razor shown in FIG. 1.

The razor includes a handle 1 that is held while a user is shaving his facial hair. A head 2 is connected to the top end of the handle 1. The top end of the handle 1 is where the cutting operations occur when in use by the user. As shown in FIG. 1, head 2 includes several razor blades 3, which run laterally from one side of the head 2 (the left side) to the opposite side of the head 2 (the right side). The razor blades 3 are disposed on a face of the head 2 and are designed to cut facial hair, e.g. beard hair. A lubricating strip 4 is disposed on the face of the head 2.

Each head side 11 of the head 2 has a respective trimming blade 5 for cutting nose hair and a recess. The recess of the head side 11 provides a pathway for the trimming blade 5 to extend from its respective side or retract into its respective head side 11. In a resting, or non-use state, the user depresses plunger 6, which extends the trimming blade 5 from the recess in the head side 11. The user can then use the trimming blade 5 to trim nose hairs. When the user has finished trimming his nose hairs, the user again depresses the plunger 6, which retracts the trimming blade 5 into the recess on the head side 11. When retracted, the trimming blade 5 is retracted completely within the recess of the head side 11.

The trimming blade 5 has a cutting edge on its bottom edge. The trimming blade 5 is shorter than the head 2. In an exemplary embodiment, there are left and right trimming blades 5, each of which are connected to a respective plunger 6. The plungers 6 are seated in the bottom of the handle 1, opposite of the head 2.

Figure 8:
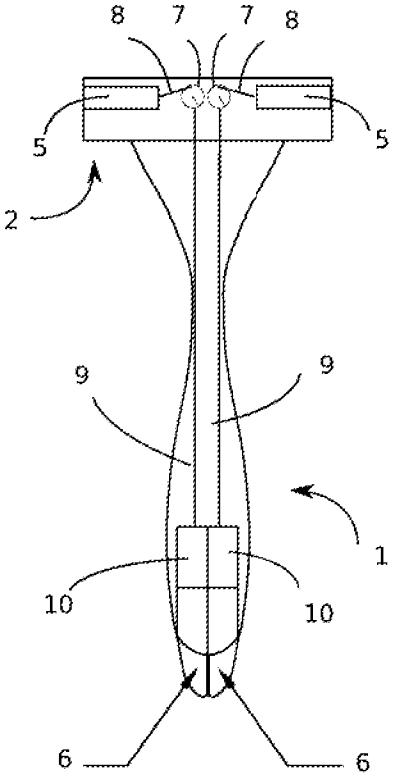
FIG. 8 is a sectional view of the razor show in FIG. 1, with the trimming blades retracted.
Figure 9:
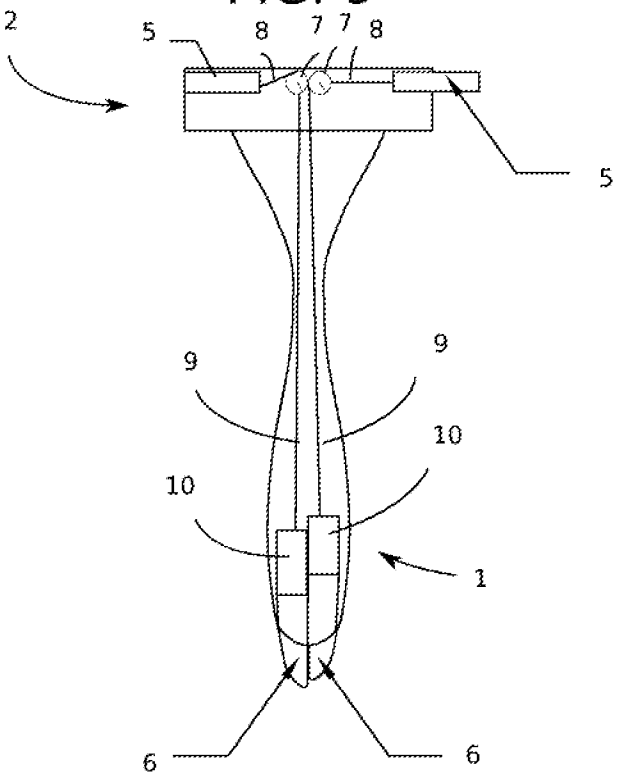
FIG. 9 is a sectional view of the razor show in FIG. 8, with the left trimming blade extended and the right trimming blade retracted.

The trimming blade is extended (or deployed) when the plunger 6 engages a linkage system within the handle 1 and head 2. FIGS. 8 and 9 show the preferred embodiment of the linkage system between each trimming blade 5 and plunger 6, that is the left and right trimming blades 5.

Each linkage system includes a standard retractable-pen linkage 10. A retractable-pen linkage 10 operation is known in the industry, whereby a system of springs, rods, guide pins, and other mechanical components allow the engagement of the plunger to actuate the trimming blade 5.

The retractable-pen linkage 10 is actuated by pressing plunger 6. Each retractable-pen linkage 10 is connected to a respective plunger link 9. Each plunger link 9 interconnects the retractable-pen linkage 10 and a cam 7. Each cam 7 is further connected to a blade link 8. The blade link 8 interconnects the cam 7 and the trimming blade 5. The linkage forms a kinematic chain between each plunger 6 and a respective trimming blade 5.

Blade link 8 and plunger link 9 are made of any material capable of withstanding the repeated actuating of the plunger 6. Materials may include metal wire or polymers. The connection of plunger link 9 to plunger 6 and cam 7, in addition to the connection of blade link 8 to cam 7 and trimming blade 5, allow for the movement of the trimming blade 5 in and out of the head 2.

Figure 4:
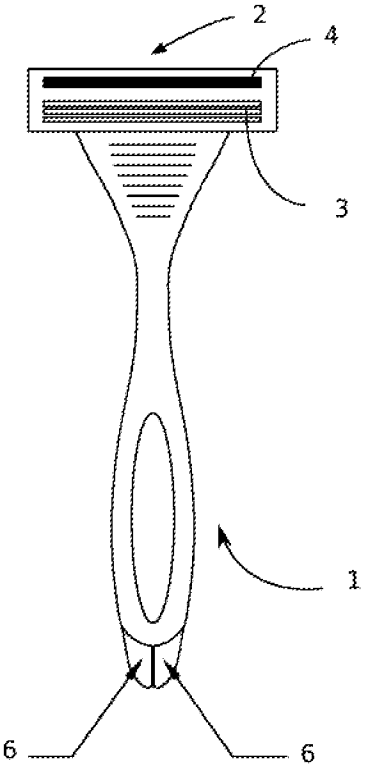
FIG. 4 is a front elevational view of the razor shown in FIG. 1, showing the trimming blades retracted.
Figure 7:
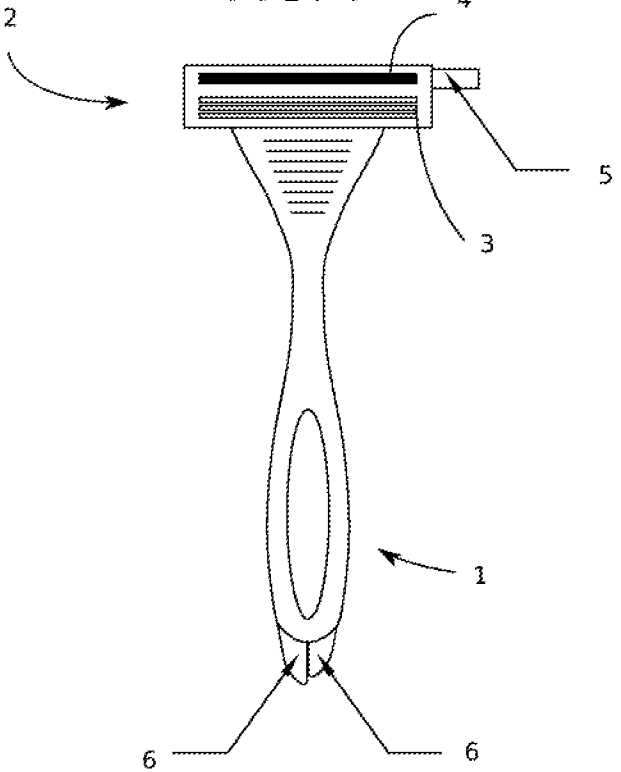
FIG. 7 is a front elevational view of the razor show in FIG. 1, with the right trimming blade retracted and the left trimming blade extended.
Figure 6:
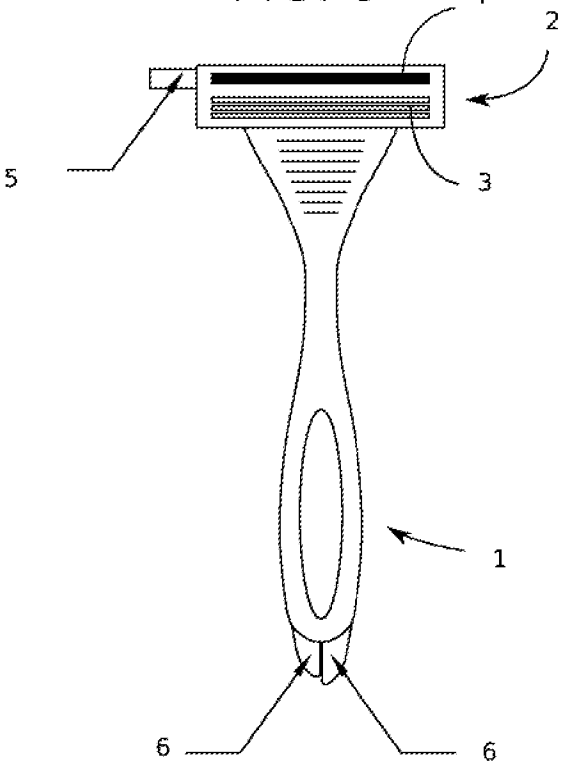
FIG. 6 is a front elevational view of the razor show in FIG. 1, with the right trimming blade extended and the left trimming blade retracted.

Actuating the plunger 6 a first time causes the trimming blade 5 to extend from the recess of head side 11 of the head 2. FIGS. 1, 2, 5, 6, 7, and 9 show the razor with at least one of the trimming blades 5 in an extended position. Actuating the plunger 6 a second time causes the trimming blade 5 to retract into the head 2. FIGS. 4 and 8 show the razor with both trimming blades 5 in a retracted position.

To trim hair in a location that is narrower than the head 2 of the razor but wide enough to accommodate the trimming blade 5, a user extends the trimming blade 5 from the head 2 by pressing the plunger 6. The user places the trimming blade 5 against the hair and pulls the trimming blade 5 against the hair to be cut. When finished, the user presses the plunger 6 to retract the trimming blade 5 into the head. While facial and nose hair are described herein, the present invention can be used on other types of human hair besides nose hair, such as ear hair.

As shown in FIGS. 1, 2, 6, 7, 8, and 9, the present invention optionally includes a left and right trimming blade 5. Users that are left handed and right handed can use either side of the head 2 to engage a trimming blade 5. In addition, the user's hand grip on handle 1 allows the user to use the left or right trimming blade 5 in either hand.

In an exemplary embodiment, the present invention includes both a left and right trimming blade with a respective left and right linkage system. A left plunger is located on the bottom of the handle 1, on the opposite end of head 2. The left plunger is connected to trimming blade 5 through a linkage system, including a retractable pen linkage 10. When the left plunger is pressed, the linkage system deploys the left trimming blade from its retracted position. When the left plunger is actuated again, the linkage systems retracts the left trimming blade from its extended/deployed position. The same operation occurs for the right trimming blade, plunger, and linkage system.

In yet another exemplary embodiment, the left and right plungers are actuated in unison to deploy the and retract the respective left and right trimming blades at the same time. Either the user pressers both left and right plungers at the same time, or a connector is engaged to link the left and right plungers so they can only operate in unison.

In yet another exemplary embodiment, the present invention includes a method for deploying a trimming blade on the side of a razor head 5 for trimming nose hair. First, the user depresses plunger 6 on handle 1. Second, the linkage system connects plunger 6 to trimming blade 5 is engaged. Third, the trimming blade 5 is extended/deployed from the recess of head side 11. Next, when the plunger 6 is depressed again, the trimming blade 5 retracts into the recess of head side 11.

What I claim is:

1. A razor for shaving hair and trimming nose hair, comprising:

a head having a left side, a right side, and a razor blade running laterally from said left side and said right side, said razor blade being configured to shave hair, said left side having a left recess formed therein, and said right side having a right recess formed therein;

a left trimming blade for cutting nose hair, said left trimming blade extending from said left side of said head when deployed, and said left trimming blade being recessed completely in said left recess when retracted;

a right trimming blade for cutting nose hair, said right trimming blade extending from said right side of said head when deployed, and said right trimming blade being recessed completely in said right recess when retracted;

a handle for holding and being connected to said head;

a left linkage connected to said left trimming blade;

a right linkage connected to said right trimming blade;

a left plunger being disposed on said handle, said left plunger being connected to said left linkage, said left plunger deploying said left trimming blade when said left trimming blade is retracted and said left plunger is actuated, and said left plunger retracting said left trimming blade when said left trimming blade is extended and said left plunger is actuated; and a right plunger being disposed on said handle, said right plunger deploying said right trimming blade when said right trimming blade is retracted and said right plunger is actuated, and said right plunger retracting said right trimming blade when said right trimming blade is extended and said right plunger is actuated.

2. The razor recited in claim 1, wherein at least one of said left linkage and said right linkage includes a retractable pen linkage connected to the respective right plunger or left plunger, the retractable pen linkage comprising a plunger link interconnected between the retractable pen linkage and a cam, the cam connected to a blade link, and the blade link interconnecting the cam and the respective right trimming blade or left trimming blade.

3. The razor recited in claim 2 further comprising a connector joining the left plunger and the right plunger, wherein:

said left and right plungers are pushed in unison to extend the left and right trimming blades; and said left and right plungers are pushed in unison to retract the left and right trimming blades.

4. A method for deploying a trimming blade on a razor for shaving hair and trimming nose hair, comprising:

providing a razor for shaving hair and trimming nose hair, comprising:

a head having a left side, a right side, and a razor blade running laterally from said left side and said right side, said razor blade being configured to shave hair, said left side having a left recess formed therein, and said right side having a right recess formed therein;

a left trimming blade for cutting nose hair, said left trimming blade extending from said left side of said head when deployed, and said left trimming blade being recessed completely in said left recess when retracted;

a right trimming blade for cutting nose hair, said right trimming blade extending from said right side of said head when deployed, and said right trimming blade being recessed completely in said right recess when retracted;

a handle for holding and being connected to said head;

a left linkage connected to said left trimming blade;

a right linkage connected to said right trimming blade;

a left plunger being disposed on said handle, said left plunger being connected to said left linkage, said left plunger deploying said left trimming blade when said left trimming blade is retracted and said left plunger is actuated, and said left plunger retracting said left trimming blade when said left trimming blade is extended and said left plunger is actuated; and a right plunger being disposed on said handle, said right plunger deploying said right trimming blade when said right trimming blade is retracted and said right plunger is actuated, and said right plunger retracting said right trimming blade when said right trimming blade is extended and said right plunger is actuated;

depressing at least one of the left plunger or the right plunger;

engaging the respective right linkage or left linkage in the handle; and deploying the respective right trimming blade or left trimming blade from said head.

5. The method for extending razor recited in claim 4, further comprising:

depressing the at least one of the left plunger or the right plunger on the handle; and retracting the respective right trimming blade or left trimming blade into a razor side of said head.

6. The method for extending razor recited in claim 5, wherein the respective right trimming blade or left trimming blade deploys and retracts from a head side of said head.

* * * * *